United States Patent [19]

Barnett

[11] Patent Number: 5,071,118

[45] Date of Patent: Dec. 10, 1991

[54] ILLUMINATED JUMP ROPE APPARATUS

[76] Inventor: Letitia G. Barnett, 315 3rd Ave., Maywood, Ill. 60153

[21] Appl. No.: 636,188

[22] Filed: Dec. 31, 1990

[51] Int. Cl.[5] ..... A63B 5/20

[52] U.S. Cl. ..... 272/75

[58] Field of Search ..... 272/74, 75; 273/DIG. 23; 446/219, 243, 485

[56] References Cited

U.S. PATENT DOCUMENTS

| | | | |
|---|---|---|---|
| 3,762,704 | 10/1973 | Gingras | 272/75 |
| 3,778,053 | 12/1973 | Smith, III et al. | 272/75 |
| 4,177,985 | 12/1979 | Hlasnicek et al. | 272/75 |
| 4,513,692 | 4/1985 | Kuhnsman et al. | 119/109 |
| 4,529,193 | 7/1985 | Kuhnsman | 272/75 |
| 4,605,219 | 8/1986 | Mahana et al. | 272/75 |
| 4,733,861 | 3/1988 | Plunkett, III | 272/75 X |
| 4,776,585 | 10/1988 | Maleyko et al. | 272/75 |
| 4,915,666 | 4/1990 | Maleyko | 272/75 X |
| 4,955,601 | 9/1990 | Ueng | 272/75 |
| 4,967,321 | 10/1990 | Cimock | 446/485 |

*Primary Examiner*—Richard J. Apley
*Assistant Examiner*—L. Thomas
*Attorney, Agent, or Firm*—Leon Gilden

[57] ABSTRACT

An apparatus wherein an elongate, flexible rope member includes a first handle mounted thereto, with a transparent sleeve overlying the rope member and mounted within a lock ring. The lock ring includes a threaded cavity to threadedly receive and compress a split, conical forward end of an oaque tube. The opaque tube includes a spring member mounted through the opaque and transparent tube and secured to the flexible rope member, whereupon release of the opaque tube by the flexible ring permits extension or contraction of the rope member within the transparent tube.

1 Claim, 4 Drawing Sheets

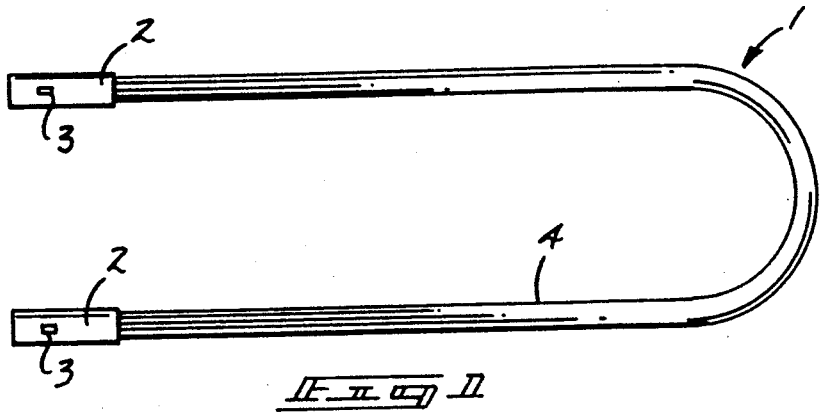
Fig 1
PRIOR ART
Fig 2
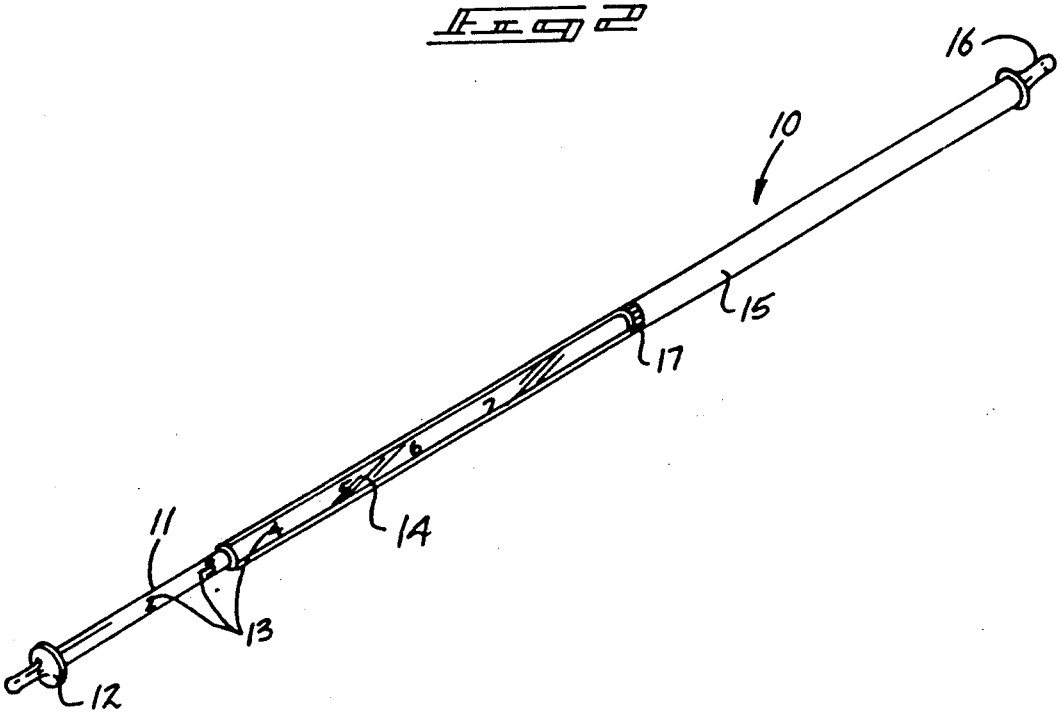

ILLUMINATED JUMP ROPE APPARATUS

BACKGROUND OF THE INVENTION

1. Field of the Invention

The field of invention relates to transparent jump rope apparatus, and more particularly pertains to a new and improved illuminated jump rope apparatus wherein the same permits selective extension and contraction of a jump rope member contained within tubular structure.

2. Description of the Prior Art

In use of jump rope apparatus, it is frequently desired to permit selective extension of a predetermined length of jump rope in use. Such adjustment accommodates individuals of various height and further permits adjustable spacing of opposed individuals utilizing the jump rope structure. Prior art jump rope apparatus may be found, for example, in U.S. Pat. No. 4,529,193 to Kuhnsman wherein an illuminated jump rope includes switches in operative association with batteries to effect illumination of the jump rope member.

U.S. Pat. No. 3,778,053 to Smith, III, et al. sets forth a musical jump rope to produce a musical tone amplified by a horn section of the handle.

U.S. Pat. No. 4,776,585 to Maleyko, et al. sets forth an electrically illuminated jump rope member utilizing batteries to effect illumination of a jump rope organization.

U.S. Pat. No. 4,605,219 to Mahana, et al. sets forth a jump rope apparatus utilizing ball bearings mounted within the handles of the jump rope structure.

U.S. Pat. No. 4,513,692 to Kuhnsman, et al. sets forth an elongate pet leash utilizing battery operative illumination of the cord portion of the leash member.

As such, it may be appreciated that there continues to be a need for a new and improved illuminated jump rope apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of jump rope apparatus now present in the prior art, the present invention provides an illuminated jump rope apparatus wherein the same permits adjustment of the jump rope structure, as well as a chemical treatment of the jump rope to effect illumination thereof. As such, the general purpose of the present invention, which will be described subsequently in greater detail, is to provide a new and improved illuminated jump rope apparatus which has all the advantages of the prior art jump rope apparatus and none of the disadvantages.

To attain this, the present invention provides an apparatus wherein an elongate, flexible rope member includes a first handle mounted thereto, with a transparent sleeve overlying the rope member and mounted within a lock ring. The lock ring includes a threaded cavity to threadedly receive and compress a split, conical forward end of an opaque tube. The opaque tube includes a spring member mounted through the opaque and transparent tube and secured to the flexible rope member, whereupon release of the opaque tube by the flexible ring permits extension or contraction of the rope member within the transparent tube.

My invention resides not in any one of these features per se, but rather in the particular combination of all of them herein disposed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved illuminated jump rope apparatus which has all the advantages of the prior art jump rope apparatus and none of the disadvantages.

It is another object of the present invention to provide a new and improved illuminated jump rope apparatus which may be easily and efficiently manufactured and marketed.

It is a further object of the present invention to provide a new and improved illuminated jump rope apparatus which is of a durable and reliable construction.

An even further object of the present invention is to provide a new and improved illuminated jump rope apparatus which is susceptible of a low cost of manufacture with regard to both materials and labor, and which accordingly is then susceptible of low prices of sale to the consuming public, thereby making such illuminated jump rope apparatus economically available to the buying public Still yet another object of the present invention is to provide a new and improved illuminated jump rope apparatus which provides in the apparatuses and methods of the prior art some of the advantages thereof, while simultaneously overcoming some of the disadvantages normally associated therewith.

Still another object of the present invention is to provide a new and improved illuminated jump rope apparatus wherein the same effects selective extension and retraction of the jump rope structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWING

The invention will be better understood and objects other than those set forth above will become apparent when consideration is given to the following detailed description thereof. Such description makes reference to the annexed drawings wherein:

FIG. 1 is an orthographic top view of a prior art illuminated jump rope apparatus.

FIG. 2 is an isometric illustration of the instant invention.

DESCRIPTION OF THE PREFERRED EMBODIMENT

Figure 3:
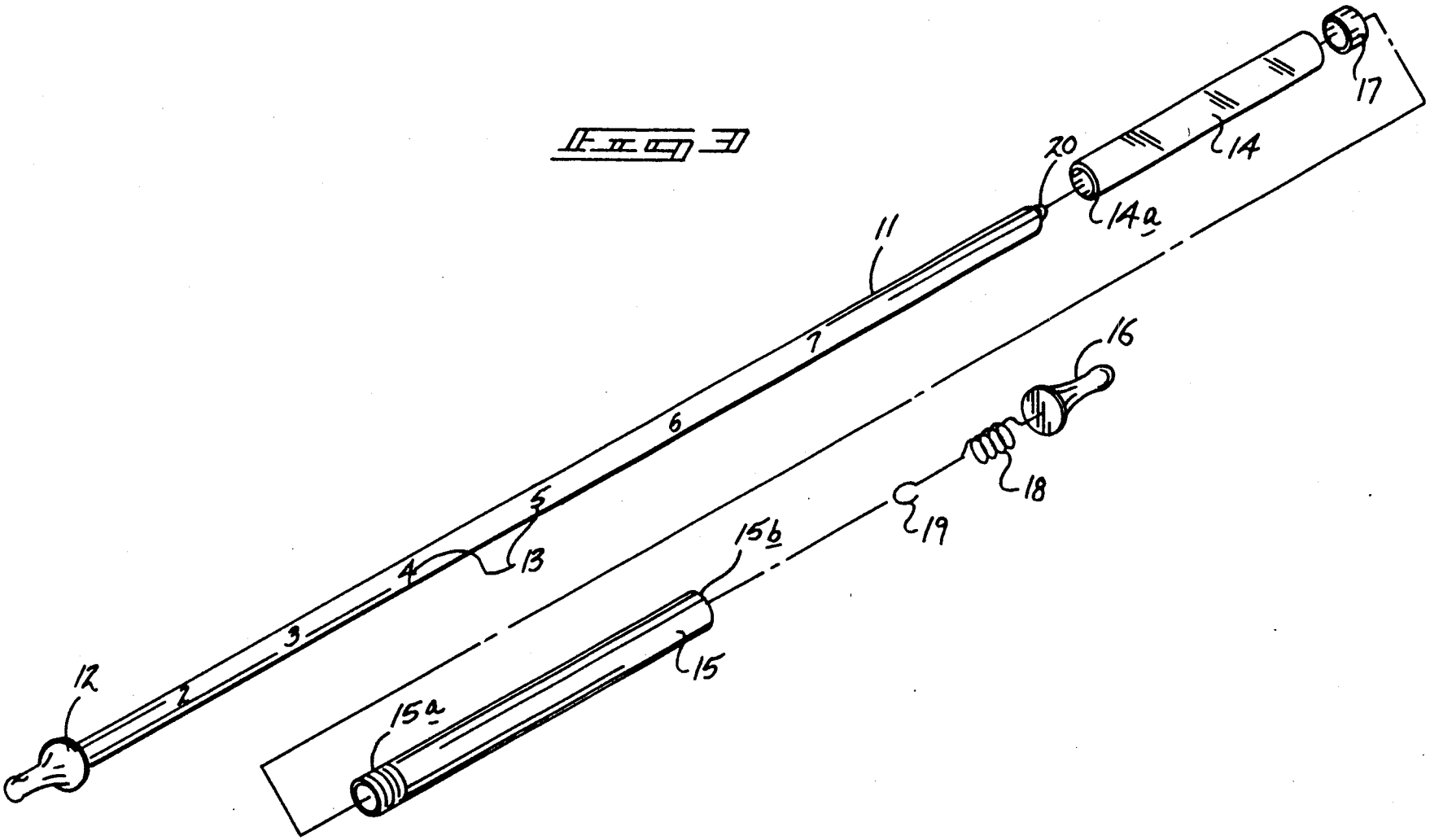
FIG. 3 is an isometric, exploded illustration of the instant invention.
Figure 4A:
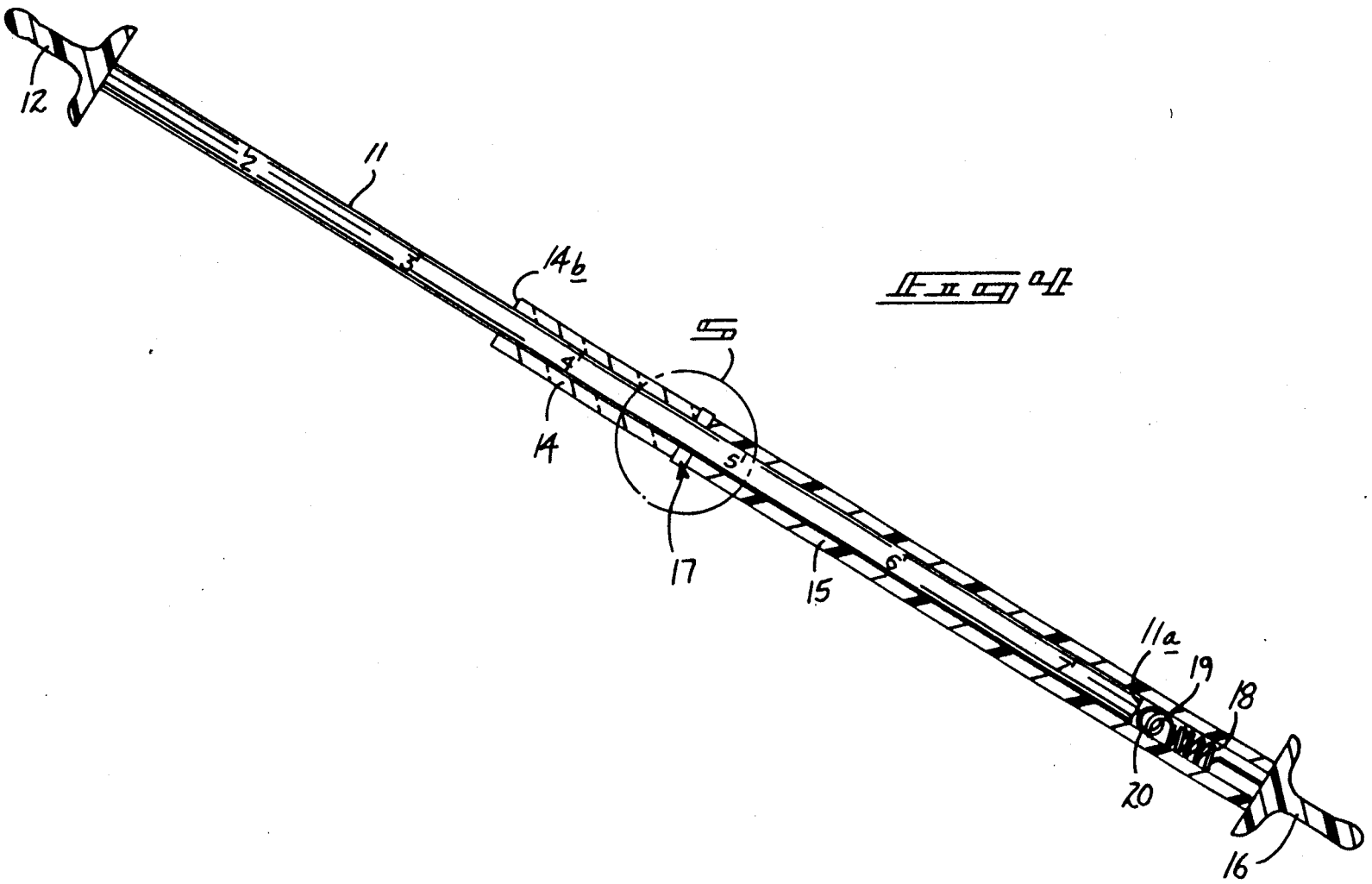
FIG. 4 is an orthographic side view, partially in cross-section, of the instant invention.

With reference now to the drawings, and in particular to FIGS. 1 to 6 thereof, a new and improved illuminated jump rope apparatus embodying the principles and concepts of the present invention and generally designated by the reference numeral 10 will be described.

FIG. 1 illustrates a prior art illuminated jump rope apparatus 1, wherein the handles 2 cooperate with switches 3 to effect illumination of the jump rope 4 utilizing battery powered illumination apparatus, in a manner as set forth in U.S. Pat. No. 4,529,193.

More specifically, the illuminated jump rope apparatus 10 of the instant invention essentially comprises an elongate, flexible luminescent rope member 11, including a first handle 12 mounted at a forward end of the rope member 11, with a series of spaced graduations 13 directed from the first handle 12 along the rope member 11. A transparent tube 14 and an opaque tube 15 are joined together by a lock ring 17, with the transparent opaque tubes 14 and 15, as well as the lock ring 17, formed of flexible polymeric material A second handle 16 includes a spring member 18 coaxially arranged relative to the handle 16 and orthogonally mounted thereto, formed with a forward hook end 19 securable within a rope loop member 20 to secure the spring member 18 to the rear end portion 11*a* of the rope member. In this manner, the rope member 11 is normally biased interiorly of the transparent and opaque tubes 14 and 15 towards the second handle 16. To provide selective extension of the rope member 11 and visual observation of a desired length extending from a transparent tube rear end portion 14*b*, the lock ring 17 cooperates with a forward opaque tube and 15*a* to effect selective clamping of the rope member 11 as it is directed through the forward opaque tube end 15*a*. It should be noted that the opaque tube rear end portion 15*b* is fixed relative to the second handle 16.

Figure 5:
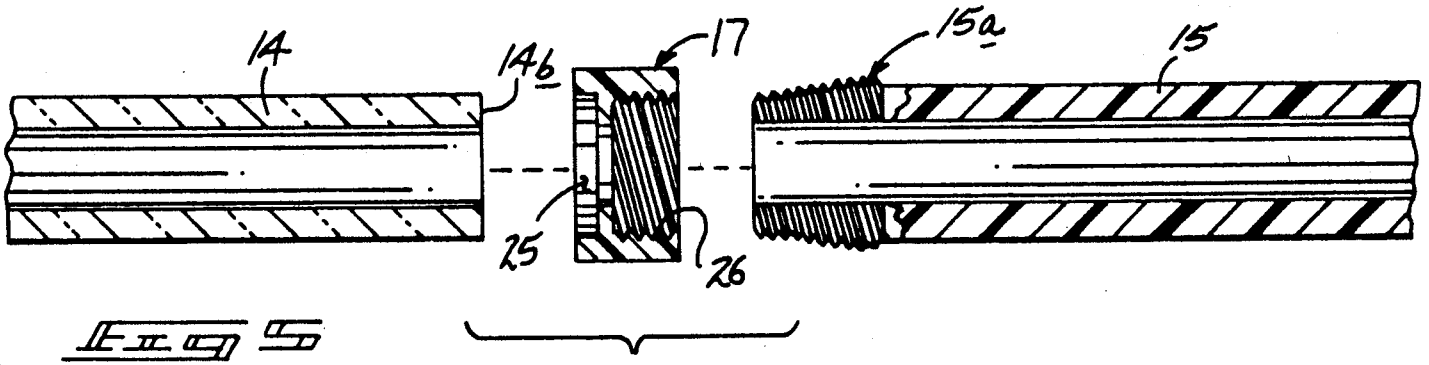
FIG. 5 is an enlarged illustration of section 5 as set forth in FIG. 4.
Figure 6:
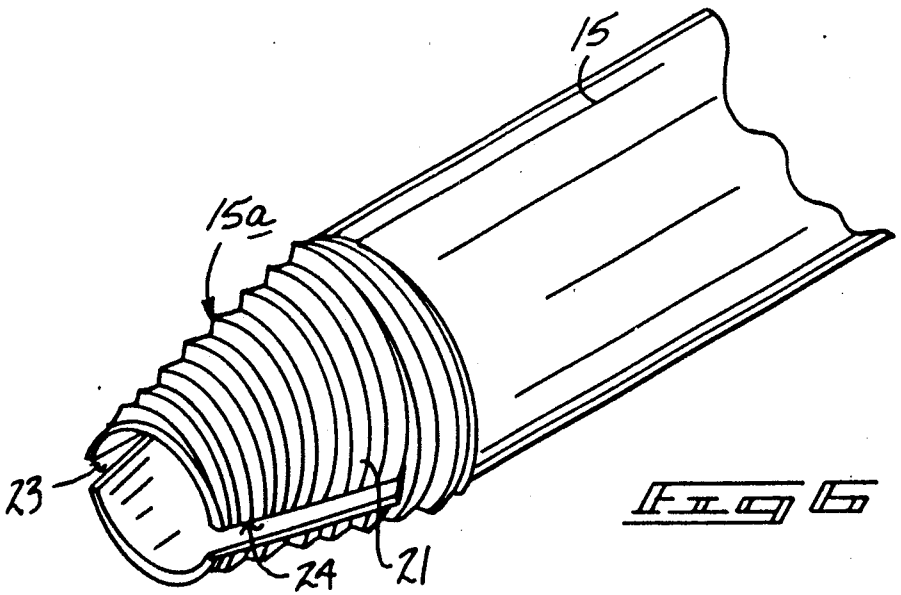
FIG. 6 is an isometric, enlarged illustration of the forward threaded end portion of the opaque tube utilized by the instant invention.

Reference to FIG. 5 illustrates the lock ring 17, with a cylindrical recess 25 complementarily receiving the transparent tube rear end 14*b* therewithin. A forward end of the lock ring 17 includes a cylindrically threaded cavity 26 coaxially aligned with the recess 25. The cylindrical cavity 26 effects an interference fit with a conically threaded surface 21 of the forward opaque tube end 15*a*. The conically tapered threaded surface 21 includes a first and second compression slot 23 and 24 that clampingly receives a rope member 11 therethrough. It should be understood that upon threading of the cylindrically threaded cavity 26 over the conically threaded surface 21, clamping of the tube within the forward opaque tube end 15*a* is effected. The opposed slots 23 and 24 are positioned on each side of a defined axis of the conically tapered threaded surface 21.

It should be further noted that the rope member 11 is preferably treated with a chemically luminescent material to permit visual enhancement of the organization in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated jump rope apparatus comprising, in combination:

a flexible rope member, the rope member including a rear end portion and a forward end portion, the rear end portion including a first handle fixedly mounted thereto, and the forward end portion including a first securement member, and a second handle, with the second handle including a biasing means, the biasing means including a second securement member secured to the first securement member to bias the rope member to the second handle, and tube means receiving the rope member therethrough, with the tube means mounted to the second handle for effecting clamping of the rope member therethrough and thereby effecting an adjustable portion of the rope member extending exteriorly of the tube means, and wherein the tube means includes an opaque tube, the opaque tube including a forward opaque tube end and a rear opaque tube end, wherein the rear opaque tube and is fixedly mounted to the second handle, and the biasing means is coaxially received within the opaque tube, and the forward opaque tube end including a conically threaded exterior surface, and the tube means further including a transparent tube, and the transparent tube including a transparent tube rear end portion, and the transparent tube rear end portion mounted to a lock ring, the lock ring including a cylindrical recess complementarily and fixedly receiving the transparent tube rear end therewithin, and the lock ring further including a cylindrically threaded forward end portion securable to the conically threaded surface of the forward opaque tube end, and wherein the rope member coaxially extends to the transparent tube, the lock ring, and the opaque tube, and wherein the biasing means includes a spring member, and the second securement member includes a hook, and the first securement member includes a loop, with the hook secured to the loop, and wherein the rope member is luminescent and is visibly observed through the transparent tube.

* * * * *